US010821465B2

(12) United States Patent
Ma et al.

(10) Patent No.: US 10,821,465 B2
(45) Date of Patent: Nov. 3, 2020

(54) SPHERICAL CORE SPRAYING TOOL

(71) Applicant: WUZHONG INSTRUMENT CO., LTD., Wuzhong (CN)

(72) Inventors: Yushan Ma, Wuzhong (CN); Jun Li, Wuzhong (CN); Zhandong Chang, Wuzhong (CN); Yongxing Zhou, Wuzhong (CN); Yongxiang Ding, Wuzhong (CN); Husheng Li, Wuzhong (CN)

(73) Assignee: WUZHONG INSTRUMENT CO., LTD., Wuzhong (CN)

( * ) Notice: Subject to any disclaimer, the term of this patent is extended or adjusted under 35 U.S.C. 154(b) by 139 days.

(21) Appl. No.: 16/089,117

(22) PCT Filed: Dec. 27, 2016

(86) PCT No.: PCT/CN2016/112246
§ 371 (c)(1),
(2) Date: Sep. 27, 2018

(87) PCT Pub. No.: WO2017/166875
PCT Pub. Date: Oct. 5, 2017

(65) Prior Publication Data

US 2019/0176180 A1 Jun. 13, 2019

(30) Foreign Application Priority Data

Mar. 28, 2016 (CN) ..... 2016 1 0180589

(51) Int. Cl.
*B05B 13/02* (2006.01)
*B05C 13/02* (2006.01)
(Continued)

(52) U.S. Cl.
CPC ..... *B05B 13/0292* (2013.01); *B05B 13/0285* (2013.01); *B05C 5/002* (2013.01);
(Continued)

(58) Field of Classification Search
CPC . B05B 13/02; B05B 13/0292; B05B 13/0285; B05C 3/09; B05C 5/00;
(Continued)

(56) References Cited

U.S. PATENT DOCUMENTS 3,677,807 A 7/1972 Curtis et al.
7,735,449 B1 * 6/2010 Harold ..... B05B 13/0207 118/500
2004/0022948 A1 2/2004 Brown et al.

FOREIGN PATENT DOCUMENTS

CN 1260049 A 7/2000
CN 101954322 A 1/2011
(Continued)

OTHER PUBLICATIONS

"Office Action and Search Report for Priority Application 201610180589.7", dated Jul. 28, 2017.
(Continued)

*Primary Examiner* — Laura Edwards
(74) *Attorney, Agent, or Firm* — Benjamin C. Armitage; Billion & Armitage

(57) ABSTRACT

A spherical core spraying tool comprises a spraying spindle and connecting rods; the spraying spindle is circumferentially provided with a plurality of protruding rings, and is axially provided with a strip-shaped groove; the connecting rods are disposed in the groove; one end of the spraying spindle is a power input end, and the other end is provided with a locking sleeve; the groove runs through the protruding rings. By spot-welding steel balls in an inner hole of a spherical core and fitting the spherical core over the spraying spindle, the steel balls are stuck in the groove of the spraying spindle, and the both sides of the steel balls are tightened by means of the connecting rods in abutting-against fashion, so that a plurality of spherical cores is fixed together with the
(Continued)

spraying spindle, and the plurality of spherical cores can be spray-coated simultaneously, thereby improving the efficiency.

5 Claims, 3 Drawing Sheets

(51) Int. Cl.
*B05C 5/00* (2006.01)
*B05C 7/00* (2006.01)

(52) U.S. Cl.
CPC ..... *B05C 7/00* (2013.01); *B05C 13/02* (2013.01); *B05C 13/025* (2013.01)

(58) Field of Classification Search
CPC .. B05C 7/00; B05C 7/02; B05C 5/002; B05C 13/02; B05C 13/025
USPC ..... 118/500, 300
See application file for complete search history.

(56) References Cited

FOREIGN PATENT DOCUMENTS

| | | | | |
|---|---|---|---|---|
| CN | 202638674 | U | | 1/2013 |
| CN | 202845252 | U | | 4/2013 |
| CN | 203196822 | U | | 9/2013 |
| CN | 103357532 | A | | 10/2013 |
| CN | 203991041 | U | | 12/2014 |
| CN | 104437935 | A | | 3/2015 |
| CN | 204412528 | U | | 6/2015 |
| CN | 105618303 | A | | 6/2016 |
| GB | 185906 | A | | 9/1922 |
| GB | 595064 | | * | 11/1947 |
| JP | 8318186 | A | | 12/1996 |

OTHER PUBLICATIONS

"International Search Report and Written Opinion for PCT/CN2016/112246".

* cited by examiner

SPHERICAL CORE SPRAYING TOOL

CROSS REFERENCE OF RELATED APPLICATION

The present application is a national phase application of International patent application PCT/CN2016/112246 filed Dec. 27, 2016, which claims priority to Chinese patent application 201610180589.7 filed Mar. 28, 2016, all of which are incorporated by reference herein in their entirety.

TECHNICAL FIELD

The present disclosure relates to the field of spraying tool technology, and more particularly, to a spherical core spraying tool.

BACKGROUND

When spherical cores with a small aperture are sprayed, because an inner hole the spherical cores is small, there are stricter requirements for dimension and coaxiality, thus the spherical cores can be individually sprayed only by using an expanding core axis, and efficiency will be extremely low. The present disclosure provides a tool that can simultaneously spray a plurality of spherical cores.

SUMMARY

The technical problem to be solved by the present disclosure is to provide a tool that can simultaneously spray a plurality of spherical cores, in order to solve the problem in existing technology that spherical cores having a small aperture can only be individually sprayed by adopting an expanding core axis, and efficiency is extremely low.

The technical solution adopted by the present disclosure to solve the technical problem is as follows: a spherical core spraying tool includes: a spraying spindle and a connecting rod, wherein the spraying spindle is provided with a number of protruding rings in a circumferential direction, and is provided with a strip-shaped groove in an axial direction, the connecting rod is disposed in the groove, a power input end is provided at one end of the spraying spindle, and a locking sleeve is provided at the other end of the spraying spindle, and the groove penetrates through the protruding rings (2). Before a spherical core is fixed to the spraying spindle, spot-welding of a steel ball in an inner hole of the spherical core is required to be performed for the purpose of positioning. A positioning core axis, which is provided with an open slot at the top and a base at the bottom, is inserted into the spherical core, and the bottom of the spherical core comes into contact with the base, and because a height of the positioning core axis is smaller than a height of the spherical core, the positioning core axis is completely accommodated in the inner hole of the spherical core. The steel ball is then placed in the open slot of the positioning core axis, the steel ball is in contact with a wall of the inner hole of the spherical core, and then the steel ball is spot-welded to the wall of the inner hole of the spherical core, in such a manner that a position of the steel ball in the inner hole of each of the spherical cores is identical. The positioning core axis is taken out of the spherical core, and then the spherical core, to which the steel ball is welded, is fitted to the protruding rings on the spraying spindle, so that the steel ball is stuck in the groove of the spraying spindle, the wall of the inner hole of the spherical core is attached to the protruding ring, and then one of the connecting rods is placed in the groove to tighten the steel ball in abutting-against fashion, in this way, the spherical core is fixed on the spraying spindle. After the spherical cores, a number of which is the same as that of the protruding rings, are fixed on the spraying spindle according to the above-described steps, the last connecting rod is fastened with the locking sleeve.

The protruding rings are equally spaced and distributed on the spraying spindle so that the spherical cores fixed on the spraying spindle are equally spaced apart from each other. The spherical cores are sprayed by using an automatic spraying device, it is only required that a spraying procedure is set to be equally spaced or at equal time intervals, thus processes can be simplified, and spraying efficiency is improved.

The spherical core is fitted to the first protruding ring near the power input end, and one side of the steel ball inside the spherical core abuts against an end portion of the groove, and the other side of the steel ball is tightened by means of one end of a connecting rod in abutting-against fashion, and the steel ball of the spherical core fitted to the second protruding ring is tightened and positioned between the other end of the connecting rod and one end of another connecting rod in abutting-against fashion, and a connecting rod close to the locking sleeve is fastened by the locking sleeve, that is, each of the spherical cores corresponds to one of the connecting rods, so the number of the connecting rods is equal to the number of the protruding rings.

The wall of the inner hole of the spherical core is fitted to the protruding ring, and the connecting rod is connected between two spherical cores. A length of the connecting rod is equal to a distance between two adjacent protruding rings. A cross-section of the power input end of the spraying spindle is a polygonal, and the power input end and a driving device form molded surface connection, strength of which is high, and no stress concentration is caused, in this way, large torque can be transmitted, high efficiency can be obtained, and impact load can be withstood.

The advantageous effects of the present disclosure are as follows: by spot-welding the steel ball in the inner hole of the spherical core and fitting the spherical core to the spraying spindle, the steel ball is stuck in the groove of the spraying spindle, and both sides of the steel ball are tightened by means of the connecting rods in abutting-against fashion, so that the plurality of spherical cores are fixed to the spraying spindle, and can be sprayed simultaneously, thereby improving the efficiency.

BRIEF DESCRIPTION OF THE DRAWINGS

Hereinafter, the present disclosure will be further described in conjunction with the accompanying drawings and embodiments.

Figure 1:
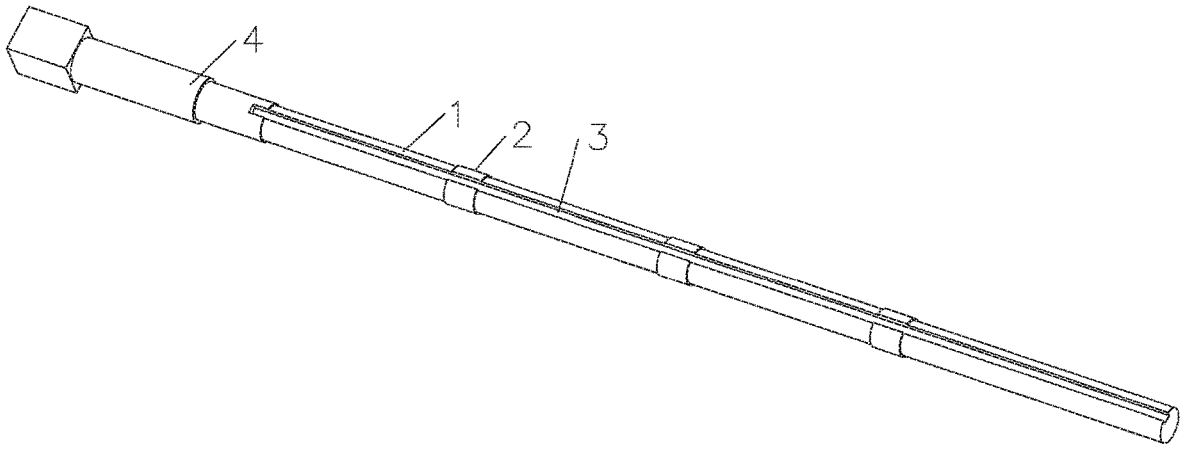
FIG. 1 is a structural schematic diagram illustrating a spraying spindle according to the present disclosure.

In the drawings: 1.spraying spindle; 2.protruding ring; 3.groove; 4.power input end; 5.locking sleeve; 6.connecting rod; 7.spherical core; 8.base; 9.positioning core axis; 10.open slot; 11.steel ball.

DETAILED DESCRIPTION

The present disclosure will now be further described in detail with reference to the accompanying drawings. The drawings are simplified schematic diagrams, and are only illustrative of a basic structure of the present disclosure schematically, thus only configurations related to the present disclosure are shown.

Figure 2:
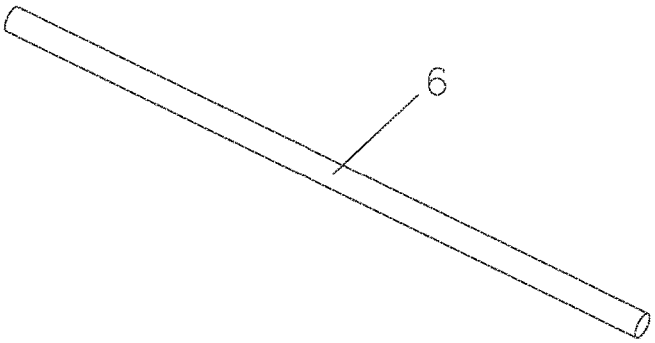
FIG. 2 is a structural schematic diagram illustrating a connecting rod according to the present disclosure.

As shown in FIGS. 1 and 2, a spherical core spraying tool includes a spraying spindle 1 and a connecting rod 6. The spraying spindle 1 is circumferentially provided with four protruding rings 2, and is axially provided with a strip-shaped groove 3. The connecting rod 6 is disposed inside the groove 3. A power input end 4 is provided at one end of the spraying spindle 1, and a locking sleeve 5 is provided at the other end of the spraying spindle 1. The groove 3 penetrates through the four protruding rings 2. The protruding rings 2 are distributed on the spraying spindle 1 at equal intervals. A number of the connecting rods 6 is equal to a number of the protruding rings 2, and a length of the connecting rod 6 is equal to a distance between two adjacent protruding rings 2. A shape of a cross-section of the power input end 4 of the spraying spindle 1 is a square, and may also be a triangle, a regular hexagon and so on.

Figure 3:
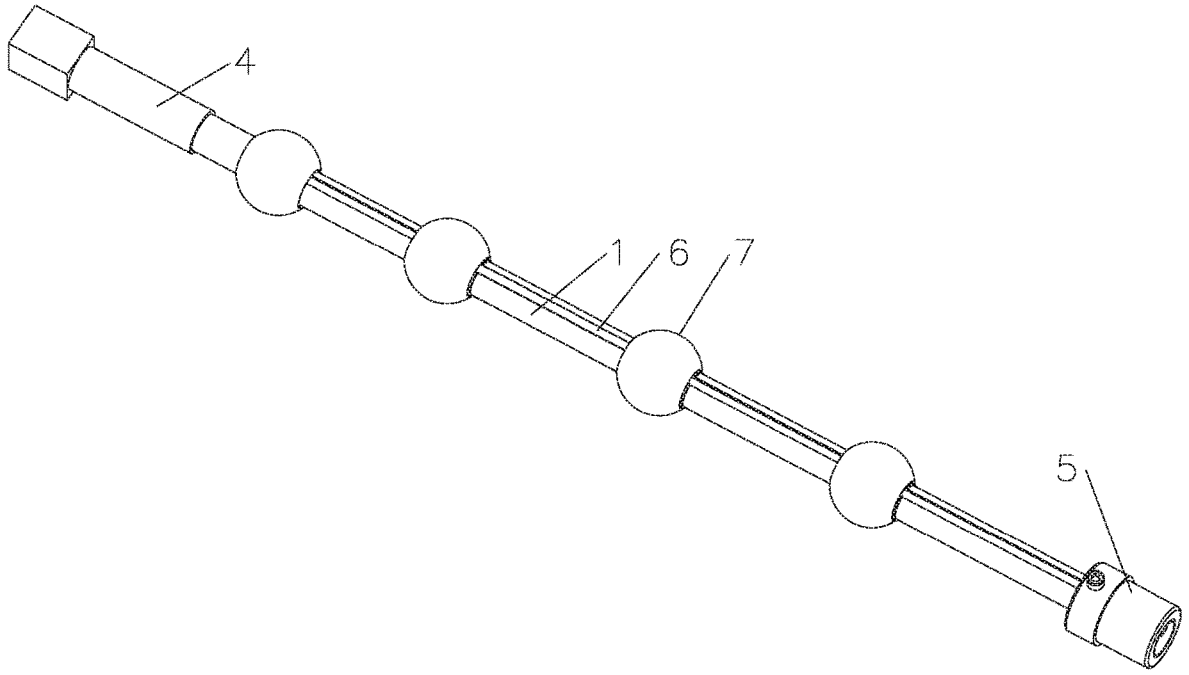
FIG. 3 is a schematic diagram illustrating an operating state according to the present disclosure.
Figure 4:
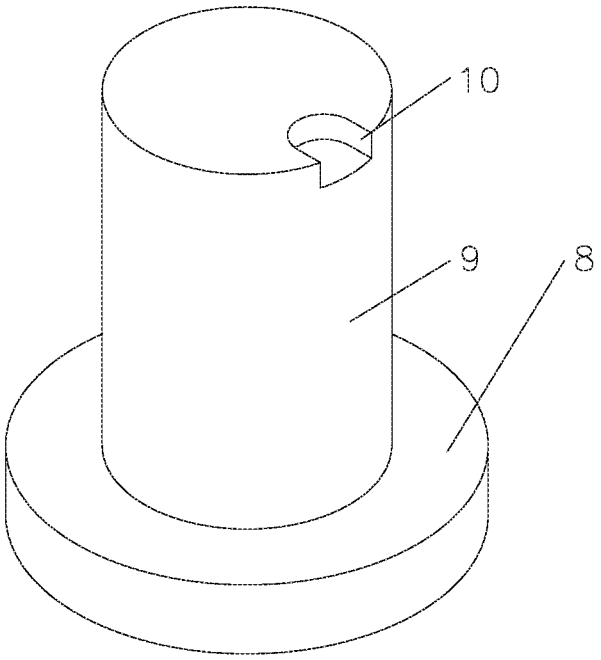
FIG. 4 is a structural schematic diagram illustrating a positioning core axis according to an embodiment.
Figure 5:
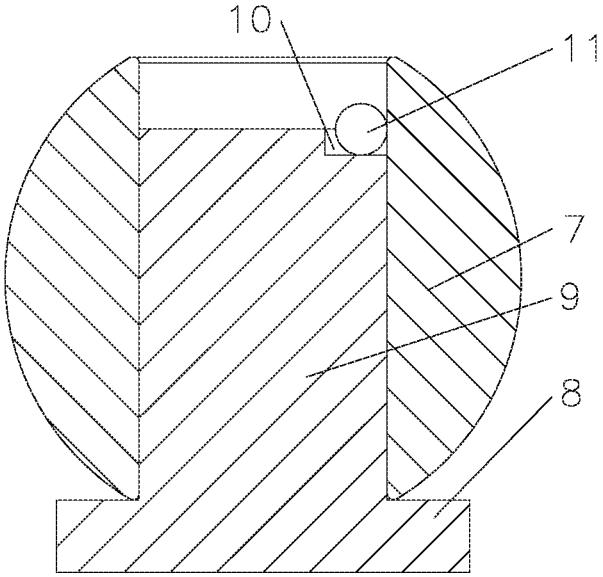
FIG. 5 is a structural schematic diagram illustrating a cross-section of a positioning core axis in an operating state.

Before a spherical core 7 is fixed to the spraying spindle 1, spot-welding of a steel ball 11 in an inner hole of the spherical core 7 is required to be performed for the purpose of positioning. As shown in FIGS. 4 and 5, a positioning core axis 9, which is provided with an open slot 10 at the top and a base 8 at the bottom, is inserted into the spherical core 7, and the bottom of the spherical core 7 comes into contact with the base 8. Since a height of the positioning core axis 9 is smaller than a height of the spherical core 7, the positioning core axis 9 is completely accommodated in the inner hole of the spherical core 7. The steel ball 11 is then placed in the open slot 10 of the positioning core axis 9, the steel ball 11 is in contact with a wall of the inner hole of the spherical core 7, and then the steel ball 11 is spot-welded to the wall of the inner hole of the spherical core 7, in such a manner that a position of the steel ball 11 in the inner hole of each of the spherical cores 7 is identical. As shown in FIG. 3, the positioning core axis 9 is taken out of the spherical core 7, and then the spherical core 7, to which the steel ball 11 is welded, is fitted to the protruding ring 2 on the spraying spindle 1 close to the power input end 4, so that the steel ball 11 is stuck in the groove 3 of the spraying spindle 1, the wall of the inner hole of the spherical core 7 is attached to the protruding ring 2, and then one of the connecting rods 6 is placed in the groove 3 to tighten the steel ball 11 in abutting-against fashion, and both ends of the steel ball 11 are respectively clamped between an end portion of the groove 3 and one end of the connecting rod 6, in this way, the spherical core 7 is fixed on the spraying spindle 1. After four spherical cores 7 are fixed on the spraying spindle 1 according to the above-described steps, the last connecting rod 6 is fastened with the locking sleeve 5. The protruding rings 2 are equally spaced and distributed on the spraying spindle 1 so that the spherical cores 7 fixed on the spraying spindle 1 are equally spaced apart from each other. The spherical cores 7 are sprayed by an automatic spraying device, it is only required that a spraying procedure is set to be equally spaced or at equal time intervals, thus processes can be simplified, and spraying efficiency is improved. The spherical core 7 is fitted to the first protruding ring 2 near the power input end 4, and one side of the steel ball 11 inside the spherical core 7 abuts against the end portion of the groove 3, and the other side of the steel ball 11 is tightened by means of one end of one connecting rod 6 in abutting-against fashion, and the steel ball 11 of the spherical core 7 fitted to the second protruding ring 2 is tightened and positioned between the other end of the one connecting rod 6 and one end of another connecting rod 6 in abutting-against fashion, and the connecting rod 6 close to the locking sleeve 5 is fastened by the locking sleeve 5, that is, each of the spherical cores 7 corresponds to one of the connecting rods 6, so the number of the connecting rods 6 is equal to the number of the protruding rings 2. The wall of the inner hole of the spherical core 7 is fitted to the protruding ring 2, and one of the connecting rod 6 is connected between two of the spherical cores 7. The length of the connecting rod 6 is equal to the distance between the two adjacent protruding rings 2. The cross-section of the power input end 4 of the spraying spindle 1 is a polygonal, and the power input end 4 and a driving device form molded surface connection, strength of which is high, and no stress concentration is caused, thereby, large torque can be transmitted, high efficiency can be obtained, and impact load can be withstood.

In view of the above-described embodiments of the present disclosure, various changes and modifications can be made by those skilled in the art without departing from the scope of the technical idea of the present disclosure. The technical scope of the present disclosure is not limited to the contents of the specification, and the technical scope thereof must be determined according to the scope of the claims.

What is claimed is:

1. A spherical core spraying tool, comprising: a spraying spindle (1) and connecting rods (6), wherein the spraying spindle (1) is provided with a number of protruding rings (2) in a circumferential direction, and is provided with a strip-shaped groove (3) in an axial direction, the connecting rods (6) are disposed in the groove (3), a power drive input end (4) is provided at one end of the spraying spindle (1), and a locking sleeve (5) is provided at the other end of the spraying spindle (1), and the groove (3) penetrates through the protruding rings (2), wherein a respective one of the connecting rods (6) is arranged in the groove (3) between every two adjacent protruding rings (2), and a last one of the connecting rods (6) is arranged in the groove (3) between the protruding ring (2) closest to the locking sleeve (5) and the locking sleeve (5), the protruding rings (2), the groove (3) and the connecting rods (6) cooperate with spherical cores (7) to be sprayed, so that when the spherical cores (7) are respectively sleeved on the protruding rings (2), ends of the connecting rods (6) are pressed against the corresponding spherical cores (7) except that an end of the last one connecting rod (6) closest to the locking sleeve (5) is fastened with the locking sleeve (5).

2. The spherical core spraying tool according to claim 1, wherein the protruding rings (2) are equally spaced and distributed on the spraying spindle (1).

3. The spherical core spraying tool according to claim 2, wherein a number of the connecting rods (6) is equal to a number of the protruding rings (2).

4. The spherical core spraying tool according to claim 3, wherein a length of the connecting rod (6) is equal to a distance between two adjacent protruding rings (2).

5. The spherical core spraying tool according to claim 1, wherein a cross-section of the power input drive end (4) of the spraying spindle (1) is a polygonal.

* * * * *